US006081937A

United States Patent [19]

Whitacre

[11] Patent Number: 6,081,937

[45] Date of Patent: Jul. 4, 2000

[54] APPARATUS FOR REDUCING URINARY SPLASH FROM COMMODE

[76] Inventor: D. Gregg Whitacre, 901 Laurel Park La., Charlotte, N.C. 28270

[21] Appl. No.: 09/221,370

[22] Filed: Dec. 28, 1998

[51] Int. Cl.[7] ..... E03D 9/00

[52] U.S. Cl. ..... 4/300.3

[58] Field of Search ..... 4/300.3, 661, 902

[56] References Cited

U.S. PATENT DOCUMENTS

| | | | |
|---|---|---|---|
| 3,661,690 | 5/1972 | Taranto . | |
| 4,062,070 | 12/1977 | Prince . | |
| 5,031,253 | 7/1991 | Brendlinger | 4/300.3 |
| 5,150,481 | 9/1992 | Pang . | |
| 5,343,577 | 9/1994 | Petrovich . | |
| 5,373,589 | 12/1994 | Rego et al. . | |
| 5,644,801 | 7/1997 | Zhao et al. . | |
| 5,813,058 | 9/1998 | Quigely et al. . | |

*Primary Examiner*—Charles E. Phillips

[57] ABSTRACT

The present invention generally discloses an apparatus for absorbing the impact of a stream of liquid entering a body of liquid so as to minimize splash. More particularly, the present invention discloses such an apparatus that may be used advantageously within a standard commode bowl to minimize or eliminate the amount of splash caused by a stream of urine impacting the body of water contained within the commode bowl. Preferably, such an apparatus is capable of floating substantially upon the surface of the body of water within the commode bowl prior to and during use, easy to use, inexpensive to manufacturer, sanitary, and easily disposable after use by flushing the commode.

6 Claims, 1 Drawing Sheet

10

APPARATUS FOR REDUCING URINARY SPLASH FROM COMMODE

BACKGROUND OF THE INVENTION

The present invention relates broadly to devices for absorbing the impact of a stream of liquid and, more particularly, to a device and method capable of minimizing the amount of splash caused by the impact of a stream of urine with the body of water in a commode. In the preferred embodiment, the device is a floatable, single-use, disposable, and partially water-soluble paper product that can be used to such advantage, which the inventor calls "men's urinary paper," or MEN'S UP, for short.

Since the development of indoor plumbing and the use of flushable, water-filled commodes, one of the greatest irritants arising between men and women is the fact that water (or more water) tends to splash out of such a commode during urination by a man than during urination by a woman. This result is not unexpected, under simple principles of physics, given the difference in distance and velocity of a urinary stream originating from a man standing in front of a commode as opposed to a woman sitting on a commode seat. In addition, since he does not sit on the commode seat, a man does not have the advantage (or disadvantage) of having his body act as a shield to prevent water from splashing out of the commode bowl.

While not seen as a problem by most men, some have attempted to address this problem in numerous innovative ways. A first method for addressing this problem includes disregarding the splash during urination and attempting to clean up the results of the splash upon completion. While such a method may ultimately achieve a satisfactory end result, it is an unsanitary procedure that does not prevent splashing from occurring in the first place. A second method may be employed by the man if the commode bowl is advantageously shaped and if the water level in the commode bowl is sufficiently low. In such a situation, the man may attempt to avoid splashing by aiming his urinary stream at the slightly exposed interior surface of the commode bowl just above the surface of the water in the commode bowl. The level of precision, dexterity, and skill required for such aim is quite difficult and unachievable one hundred percent of the time; thus, forcing the man to resort to the first method if his aim is inadequate.

A third method, which requires the man to unroll and properly place a precise amount of toilet tissue ("wad") onto the water surface in the commode prior to urination, would appear to be a potential solution to this problem; however, this method poses several difficulties. On the one hand, if an insufficient amount of toilet paper is used, the wad may float initially but, when exposed to the force of impact of an ordinary stream of urine, sinks below the surface of the water in the commode bowl and loses whatever splash preventive capability it may have initially exhibited. On the other hand, if too much toilet paper is used, the wad quickly becomes water-logged and, having no external means for buoyancy, sinks beneath the water surface and likewise becomes ineffective as a splash inhibitor. While an exorbitant amount of toilet paper could be used to create a wad large enough to absorb substantially all of the water within the commode bowl and, thus, obviate the problem of splashing, such an alternative is not desirable for several reasons. For example, wasting this amount of toilet paper for such a purpose is not cost effective, is time-consuming, and presents flushing problems with most standard commodes and plumbing.

Finally, numerous other devices that by-pass the surface water of a standard commode, such as suction devices, funnels, or the like, or devices which act as a shield or barrier to prevent splash from escaping the confines of a commode are known in the art. None of these known devices, however, provide an easy, sanitary, and inexpensive solution to this age-old problem.

BRIEF SUMMARY OF THE INVENTION

It is therefore an object of present invention to provide an apparatus for absorbing the impact of a stream of liquid entering a body of liquid.

It is also an object of the present invention to provide such an apparatus that can be used in a standard commode bowl having a body of water or other liquid therein.

It is a further object of the present invention to provide an apparatus that minimizes or eliminates the amount of splash caused by an individual's urinary stream impacting the water in a commode bowl.

It is an object of the present invention to provide an apparatus that will float substantially upon a body of water even after absorbing a predetermined amount of liquid.

It is a further object of the present invention to provide such an apparatus that is sufficiently sturdy and rigid to maintain its form after absorbing a predetermined amount of water and while being impacted by a stream of urine.

It is also an object of the present invention to provide such an apparatus that is inexpensive to manufacture, sanitary, easy to use, and flushable or otherwise easily disposable.

To that end, the present invention generally provides an apparatus for absorbing the impact of a stream of liquid entering a body of liquid having a surface, comprising a first layer of liquid-permeable material having a bottom portion formed to float just below the surface of the body of liquid, a second layer of liquid-permeable material having a top portion formed to receive and allow the stream of liquid to pass therethrough, and a layer of liquid-absorbent material disposed between the first and second liquid-permeable layers and formed to substantially absorb a predetermined amount of liquid whereby splash generated by the impact of the stream of liquid entering the body of liquid is minimized.

The first and second liquid-permeable layers each comprise an outer edge portion, which are joined together, preferably in substantially sealing contact. The first and second liquid permeable layers define a pocket therebetween for placement of the liquid-absorbent layer. More specifically, the pocket is formed between the first liquid-permeable layer, which is substantially flat, and the second liquid-permeable layer, which is substantially concave.

In the preferred embodiment, the liquid-absorbent layer is comprised of a plurality of loosely-placed or fluffed tissue paper. On the other hand, each of the liquid-permeable layers is comprised of a sheet of toilet seat cover paper.

More specifically, the present invention provides an apparatus for absorbing the impact of a stream of urine into a surface of a body of water in a commode bowl, comprising a first layer of liquid-permeable material having a bottom portion formed to float just below the surface of the body of water, a second layer of liquid-permeable material having a top portion formed to receive and allow the stream of urine to pass therethrough, and a layer of liquid-absorbent material disposed between the first and second liquid-permeable layers and formed to substantially absorb a predetermined amount of liquid whereby splash generated by the impact of the stream of urine into the body of water in the commode bowl is minimized.

In the preferred embodiment, the liquid-absorbent layer is comprised of a plurality of loosely-placed or fluffed tissue paper. On the other hand, each of the liquid-permeable layers is comprised of a sheet of toilet seat cover paper.

In addition, in the preferred embodiment, the liquid permeable layers are circular and sized to substantially cover the surface of the body of water within the commode bowl. Further, because of the nature of the materials used to manufacturer the apparatus, the entire apparatus is capable of being flushed or otherwise disposed of in the commode after use.

The present invention also discloses a method of minimizing the amount of splash caused by a stream of urine impacting a surface of a body of water in a commode bowl, comprising the steps of providing a splash-preventing apparatus similar to the one previously described, floating the splash-preventing apparatus on the surface of the body of water within the commode bowl; and urinating on the splash-preventing apparatus. Additionally, the method may include flushing the commode to dispose of the splash-preventing apparatus.

By the above, the present invention provides an apparatus for absorbing the impact of a stream of liquid entering a body of liquid so as to minimize splash. Advantageously, such an apparatus may be used within a standard commode bowl to minimize or eliminate the amount of splash caused by a stream of urine impacting a body of water within a commode bowl. Ideally, such an apparatus is easy to manufacturer, sanitary, easy to place properly within a commode bowl, capable of floating upon the water surface within the commode bowl prior to and during use, sturdy enough to maintain its relative shape during use, and capable of being flushed down a commode after use.

DESCRIPTION OF THE PREFERRED EMBODIMENT

Figure 1:
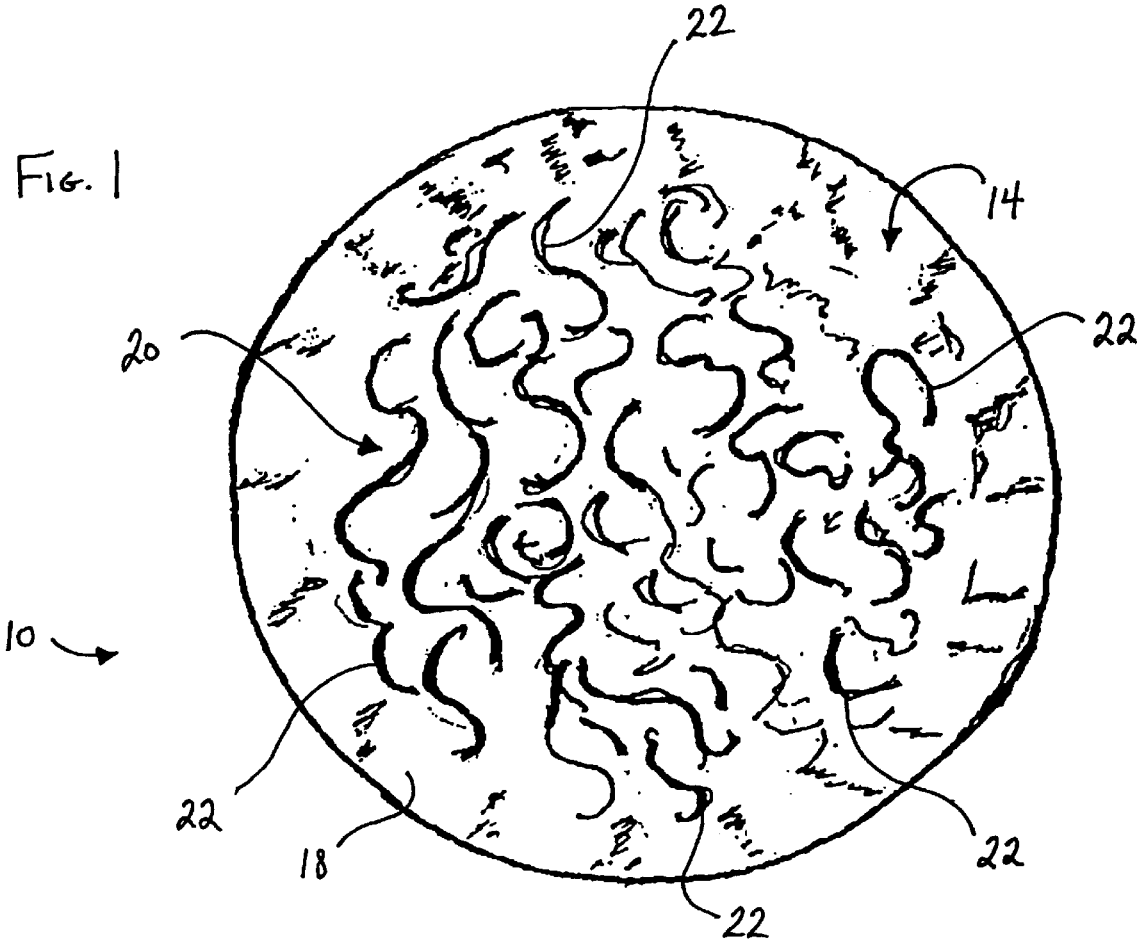
FIG. 1 is a top view of the apparatus of the present invention.
Figure 2:
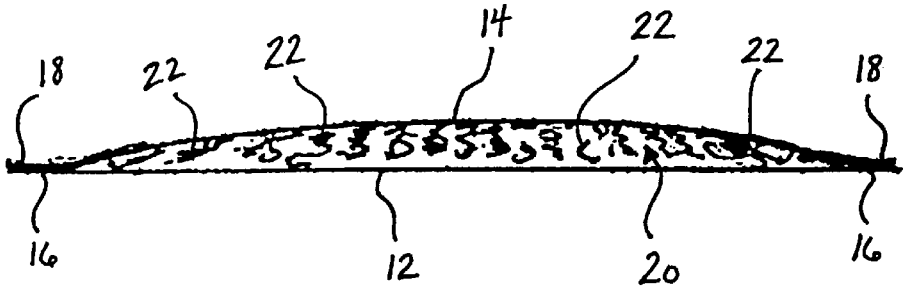
FIG. 2 is a side view of the apparatus shown in FIG. 1.

Turning now to the drawings and, more particularly, to FIGS. 1 and 2, an apparatus for absorbing the impact of a stream of liquid is illustrated generally at 10. In the preferred embodiment, such an apparatus 10 may be used advantageously on the surface of water within a commode bowl (not shown) to minimize the amount of splash caused by a stream of urine impacting the water within the commode bowl.

The apparatus 10 includes a bottom layer 12 and a top layer 14 of liquid-permeable material. In the preferred embodiment, the liquid-permeable material is formed from paper having a consistency, liquid-permeability, strength, weight, and rigidity similar to that of toilet seat cover paper manufactured and sold under the brand name NEAT SEAT® by Sanitor Manufacturing Co. located at 1221 West Centre Avenue, Kalamazoo, Mich. 49002-5384.

In the preferred embodiment, the bottom and top layers 12, 14 are circular in shape to facilitate use of the apparatus 10 within the confines of a standard commode bowl and, more particularly, the surface area of water within the commode bowl. However, the bottom and top layers 12, 14 could just as easily be shaped in a square, oval, or other pattern, to accommodate the shape of a non-standard commode bowl or, potentially, to minimize the cost of manufacture. However, regardless of which shape is used, the apparatus 10, when properly positioned by the user, should substantially cover the surface area of the water within the commode bowl.

The bottom and top liquid-permeable layers 12, 14 are joined together at their edge portions 16, 18, respectively, to form a substantially sealing contact. A perfect seal along the edge portions 16, 18 is not required so long as the bottom and top layers 12, 14 remain substantially in alignment with each other when exposed to water in a commode bowl or impacted by a stream of urine while placed on the surface of the body of water in a commode bowl (ie. for at least several minutes). Thus, the edge portions 16, 18 may be joined together by any suitable means known in the art, such as by heat, compression, crinkling, or, preferably, glue.

When designed for use in a standard commode, the bottom layer 12 is formed to have a diameter of approximately 8". As can be seen more clearly in FIG. 2, the top layer 14 has a slightly larger diameter than the bottom layer 12, which enables the top layer 14 to be shaped in a concave or dome-shaped fashion when the edge portions 16, 18 of the bottom and top layers 12, 14 are joined together. By sizing and joining the bottom and top layers 12, 14 in this manner, a pocket 20 between the bottom and top liquid-permeable layers 12, 14 is thereby created. When viewed from the side, the pocket 20 has a height of approximately ¾" for a diameter of approximately 6".

A layer of liquid-absorbent material 22 is then placed within this pocket 20 between the bottom and top liquid-permeable layers 12, 14. In the preferred embodiment, the liquid-absorbent material 22 is formed from approximately ten sheets of double-ply toilet tissue, such as NORTHERN® brand toilet tissue manufactured by the James River Corporation at Norwalk, Conn. 06856-6000, which are fluffed or otherwise loosely placed within the pocket 20. However, any comparable brand, ply, or amount of toilet tissue, regardless of manufacturer, may be used to similar effect.

In practice, a splash-preventing apparatus 10, as previously described, may be used advantageously by an individual to minimize, or even eliminate, the amount of splash caused by his urinary stream impacting the body of water within the commode bowl. The liquid-permeable and liquid-absorbing layers 12, 14, 22, respectively, are each constructed of materials that are water-soluble, bio-degradable, and otherwise flushable in a standard commode. In addition, all of the material used to construct the apparatus 10 are sufficiently light-weight to allow the apparatus 10 to float substantially at the surface of the body of water within the commode, even while being impacted by a stream of urine.

The splash-preventing apparatus 10 is advantageously shaped to cover substantially all or most of the surface area of the body of water within the commode bowl. In addition, the liquid-permeable material is sufficiently rigid to maintain its shape and form after being placed within the commode bowl and while being impacted by a stream of urine. The combination of size and rigidity of material prevents the apparatus 10 from being displaced off of the surface of the water in the commode bowl when subjected to the impact of a stream of urine.

When initially placed on the surface of water in a commode bowl, water within the commode bowl quickly passes through the bottom liquid-permeable layer 12 and is absorbed by the liquid-absorbent material 22. The weight of the liquid-absorbent material causes the bottom liquid-permeable layer 12 to sink just below the surface of the body of water; however, the top liquid-permeable layer 14 floats just above or substantially at the surface of the body of water for receiving the stream of urine and preventing the stream of urine from impact water in the commode bowl directly. Because it is sufficiently light-weight, even when completely saturated with water, the apparatus 10 can remain floating in the commode bowl indefinitely, as long as the bottom and top liquid-permeable layers 12, 14 maintain their form and rigidity.

When a stream of urine is introduced into the commode bowl, the stream impacts the top liquid-permeable layer 14, which allows the urine to pass therethrough with relative ease. The bottom liquid-permeable layer 12 maintains the liquid-absorbent layer 22 in position below the top liquid-permeable layer 14. In this manner, the liquid-absorbent layer 22 and the top liquid-permeable layer 14 absorb the impact of the stream of urine and, thus, minimize the amount of splash caused thereby.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for absorbing the impact of a stream of liquid into a body of liquid having a surface, comprising:

a first layer of liquid-permeable material having a bottom portion formed to float just below the surface of the body of liquid;

a second layer of liquid-permeable material having a top portion formed to receive and allow the stream of liquid to pass therethrough;

a layer of liquid-absorbent tissue paper material disposed between said first and second liquid-permeable layers and formed to substantially absorb a predetermined amount of liquid whereby splash generated by the impact of the stream of liquid entering the body of liquid is minimized, and wherein said first and second liquid-permeable layers each comprise an outer edge portion, said outer edge portions being joined together in substantially sealing contact.

2. The apparatus according to claim 1 wherein said first and second liquid-permeable layers define a pocket therebetween for placement of said liquid-absorbent layer.

3. The apparatus according to claim 2 wherein said first liquid-permeable layer is substantially flat and said second liquid-permeable layer Is substantially concave.

4. The apparatus according to claim 1 wherein said liquid-absorbent layer comprises a plurality of loosely placed tissue paper.

5. The apparatus according to claim 1 wherein each of said first and second liquid-permeable layers comprise a sheet of toilet seat cover papers.

6. The apparatus according to claim 5 wherein said first and second liquid-permeable layers are circular and sized to substantially cover the surface of the body of water in the commode bowl.

* * * * *